US011430299B2

(12) United States Patent
Crispino et al.

(10) Patent No.: US 11,430,299 B2
(45) **Date of Patent: *Aug. 30, 2022**

(54) GAMING MACHINE HAVING RELATED TRIGGER CONDITION AND GAME PLAY CHARACTERISTICS

(71) Applicant: Aristocrat Technologies Australia Pty Limited, North Ryde (AU)

(72) Inventors: Oliver Crispino, Rosemeadow (AU); Billy Tam, Lindfield (AU); Paul Lombardo, Newport (AU)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 0 days.

This patent is subject to a terminal disclaimer.

(21) Appl. No.: 17/150,839

(22) Filed: Jan. 15, 2021

(65) Prior Publication Data

US 2021/0134121 A1 May 6, 2021

Related U.S. Application Data

(63) Continuation of application No. 16/659,177, filed on Oct. 21, 2019, now Pat. No. 10,909,811, which is a (Continued)

(30) Foreign Application Priority Data

Jan. 12, 2017 (AU) ..... 2017900082

(51) Int. Cl.
*G07F 17/32* (2006.01)

(52) U.S. Cl.
CPC ..... *G07F 17/3267* (2013.01); *G07F 17/3209* (2013.01); *G07F 17/3213* (2013.01); *G07F 17/3223* (2013.01); *G07F 17/3269* (2013.01)

(58) Field of Classification Search
USPC ..... 463/25
See application file for complete search history.

(56) References Cited

U.S. PATENT DOCUMENTS 5,833,537 A 11/1998 Barrie
5,947,820 A 9/1999 Morro
(Continued)

FOREIGN PATENT DOCUMENTS

AU 2008202678 A1 2/2009
AU 2017279696 A1 7/2018

OTHER PUBLICATIONS

Australian Examination Report for App No. AU2019222868, dated May 22, 2020, 4 pages.

(Continued)

*Primary Examiner* — Pierre E Elisca
(74) *Attorney, Agent, or Firm* — McAndrews, Held & Malloy, Ltd.

(57) ABSTRACT

An electronic gaming machine comprises a symbol selector, in response to game initiation, selecting a plurality of symbols and causing the selected symbols to be displayed at respective ones of a plurality of symbol display positions; a trigger monitor to determine whether one or both of a first feature game trigger condition and a second feature game trigger condition are met by the displayed plurality of symbols; and a feature game controller to conduct: a first feature game having a first game play characteristic if only the first feature game trigger condition is met, a second feature game having a second game play characteristic if only the second feature game trigger condition is met, and a third feature game that combines the first game play characteristic and the second game play characteristic if both the first and the second feature game trigger conditions are met.

20 Claims, 8 Drawing Sheets

Related U.S. Application Data continuation of application No. 15/870,393, filed on Jan. 12, 2018, now Pat. No. 10,453,306.

(56) References Cited

U.S. PATENT DOCUMENTS

| | | | | |
|---|---|---|---|---|
| 6,364,765 | B1 | 4/2002 | Walker | |
| 6,428,412 | B1 | 8/2002 | Anderson | |
| 6,726,563 | B1 | 4/2004 | Baerlocher | |
| 7,601,059 | B2 | 10/2009 | Bozeman | |
| D682,301 | S | 5/2013 | Dijulio | |
| 8,460,090 | B1 | 6/2013 | Gilliland | |
| D696,265 | S | 12/2013 | D'Amore | |
| 8,608,556 | B2 | 12/2013 | Olive | |
| D767,621 | S | 9/2016 | Gagnier | |
| D768,707 | S | 10/2016 | Gagnier | |
| 9,711,006 | B2 * | 7/2017 | Kendall | G07F 17/3267 |
| 10,262,501 | B2 | 4/2019 | Satterlie | |
| D849,046 | S | 5/2019 | Kuo | |
| 10,453,306 | B2 | 10/2019 | Crispino | |
| 10,535,229 | B2 | 1/2020 | Olive | |
| D881,900 | S | 4/2020 | Harmann | |
| D888,089 | S | 6/2020 | Chaudhri | |
| D890,200 | S | 7/2020 | Kokubo | |
| D895,642 | S | 9/2020 | Hoofnagle | |
| 10,789,812 | B2 | 9/2020 | Sanborn | |
| D900,123 | S | 10/2020 | Lopes et al. | |
| D903,691 | S | 12/2020 | Olive | |
| D907,652 | S | 1/2021 | Momchilov | |
| D908,134 | S | 1/2021 | Liebowitz | |
| 10,970,958 | B2 | 4/2021 | Hirai | |
| 2002/0094856 | A1 | 7/2002 | Bennett | |
| 2003/0064793 | A1 | 4/2003 | Baerlocher | |
| 2004/0087368 | A1 | 5/2004 | Gauselmann | |
| 2004/0106448 | A1 | 6/2004 | Gauselmann | |
| 2004/0235552 | A1 | 11/2004 | Gauselmann | |
| 2005/0043082 | A1 | 2/2005 | Peterson | |
| 2006/0003829 | A1 | 1/2006 | Thomas | |
| 2006/0046830 | A1 | 3/2006 | Webb | |
| 2007/0060254 | A1 | 3/2007 | Muir | |
| 2007/0077979 | A1 | 4/2007 | Cohn | |
| 2007/0243923 | A1 | 10/2007 | Seelig | |
| 2008/0113734 | A1 | 5/2008 | Watkins | |
| 2009/0118000 | A1 | 5/2009 | Yoshizawa | |
| 2009/0197666 | A1 | 8/2009 | Visser | |
| 2009/0197668 | A1 | 8/2009 | Visser | |
| 2009/0264171 | A1 | 10/2009 | Acres | |
| 2010/0029381 | A1 | 2/2010 | Vancura | |
| 2010/0323780 | A1 | 12/2010 | Acres | |
| 2012/0122544 | A1 | 5/2012 | Roemer | |
| 2013/0065665 | A1 | 3/2013 | Watkins | |
| 2013/0065674 | A1 | 3/2013 | Luciano, Jr. | |
| 2013/0157741 | A1 | 6/2013 | Pacey | |
| 2013/0252704 | A1 | 9/2013 | Gilbertson | |
| 2013/0281181 | A1 * | 10/2013 | Langille | G07F 17/3267 463/20 |
| 2014/0100022 | A1 | 4/2014 | Lewis | |
| 2014/0135096 | A1 * | 5/2014 | Aida | G07F 17/3267 463/20 |
| 2014/0179396 | A1 | 6/2014 | Aoki | |
| 2014/0248938 | A1 | 9/2014 | Tidke | |
| 2014/0274299 | A1 * | 9/2014 | Kitamura | G07F 17/34 463/20 |
| 2014/0274308 | A1 | 9/2014 | Guinn | |
| 2014/0295942 | A1 * | 10/2014 | Kendall | G07F 17/326 463/25 |
| 2014/0364193 | A1 | 12/2014 | Williamson | |
| 2015/0094129 | A1 | 4/2015 | Acres | |
| 2015/0099569 | A1 * | 4/2015 | Suda | G07F 17/34 463/20 |
| 2015/0141114 | A1 | 5/2015 | Davis | |
| 2015/0206397 | A1 | 7/2015 | Nelson | |
| 2015/0262450 | A1 | 9/2015 | Elias | |
| 2016/0086442 | A1 | 3/2016 | Hilbert | |
| 2016/0104344 | A1 | 4/2016 | Meyer | |
| 2016/0133100 | A1 | 5/2016 | Pececnik | |
| 2016/0247361 | A1 | 8/2016 | Meyer | |
| 2017/0024955 | A1 | 1/2017 | Pawloski | |
| 2017/0024957 | A1 | 1/2017 | Boese | |
| 2017/0092047 | A1 * | 3/2017 | Hendricks | G07F 17/3225 |
| 2018/0025585 | A1 | 1/2018 | Schmidt | |
| 2018/0089942 | A1 | 3/2018 | Filipour | |
| 2018/0130296 | A1 | 5/2018 | Berman | |
| 2018/0197379 | A1 | 7/2018 | Crispino | |
| 2019/0043316 | A1 | 2/2019 | Selegue | |
| 2019/0130705 | A1 | 5/2019 | Nelson | |
| 2019/0304248 | A1 | 10/2019 | Bryant | |
| 2019/0355206 | A1 | 11/2019 | Kania | |
| 2020/0051374 | A1 | 2/2020 | Solaja | |
| 2020/0160663 | A1 | 5/2020 | Berman | |
| 2020/0312086 | A1 | 10/2020 | Kendall | |
| 2020/0312087 | A1 | 10/2020 | Kendall | |
| 2020/0312095 | A1 | 10/2020 | Kendall | |
| 2020/0357240 | A1 | 11/2020 | Tam | |
| 2021/0065513 | A1 | 3/2021 | Ludwick | |
| 2021/0104127 | A1 | 4/2021 | Schaefer | |
| 2021/0110676 | A1 | 4/2021 | Davis | |

OTHER PUBLICATIONS

Office Action dated Aug. 27, 2020 for U.S. Appl. No. 16/659,177 (pp. 1-6).

Notice of Allowance dated Sep. 29, 2020 for U.S. Appl. No. 16/659,177 (pp. 1-9).

Youtube video, "Cash Fusion—Peacock Riches," MGS Summit Macau, downloaded from https://www.youtube.com/watch?v=6jaKVWJt56Q, 1 p. (Nov. 2017).

Aristocrat Technologies Australia Pty Limited, "Fu Dai Lian Lian Panda," downloaded from https://www.aristocrat.com/apac/games/ba-bao-huang-long-emperor-2-2/, 4 pp. (downloaded on Feb. 13, 2020).

Vimeo, "Fu Dai Lian Lian," downloaded from https://vimeo.com/352401309, 10 pp. (downloaded on Feb. 13, 2020).

Office Action dated May 18, 2020 for U.S. Appl. No. 16/779,540 (pp. 1-12).

Notice of Allowance dated Aug. 27, 2020 for U.S. Appl. No. 16/779,540 (pp. 1-8).

Office Action dated Jan. 14, 2021 for U.S. Appl. No. 29/722,810 (pp. 1-7).

New Game Nice Profit Fu Dai Lian Lian Dragon Slot (Aristocrat), by KURI Slot, dated Dec. 11, 2019, youtube.com [online]. Retrieved Jan. 11, 2021 from internet <URL:https://www.youtube.com/watch?v=5kX2ZXirx_O> (Year: 2019).

Fu Dai Lian Lian, dated to Oct. 25, 2020, aristocrat-us.com [online]. Retrieved from internet <URL:https://web.archive.org/web/20201125023325/https://www.aristocrat-us.com/fu-dai-lian-1ian> (Year: 2020).

Notice of Allowance dated Feb. 18, 2021 for U.S. Appl. No. 29/722,810 (pp. 1-8).

Notice of Allowance dated Jun. 16, 2021 for U.S. Appl. No. 29/722,813 (pp. 1-9).

Julia Lemba, "Moneybag Simple Cartoon" Mar. 14, 2019 https://www.istockphoto.com/vector/moneybag-simple-cartoon-infographics-isolated-on-blue-background-moneybag-simple-gm1135787086-302281081.

Office Action dated Jun. 18, 2021 for U.S. Appl. No. 16/790,548 (pp. 1-16).

Corrected Notice of Allowability dated Jul. 8, 2021 for U.S. Appl. No. 29/722,813 (pp. 1-2).

Office Action (Non-Final Rejection) dated Jan. 7, 2022 for U.S. Appl. No. 16/830,232 (pp. 1-13).

Office Action (Non-Final Rejection) dated Jan. 21, 2022 for U.S. Appl. No. 16/830,239 (pp. 1-19).

Office Action (Final Rejection) dated Jan. 20, 2022 for U.S. Appl. No. 16/790,548 (pp. 1-16).

Office Action (Non-Final Rejection) dated Feb. 22, 2022 for U.S. Appl. No. 17/129,427 (pp. 1-10).

(56) References Cited

OTHER PUBLICATIONS

Office Action (Non-Final Rejection) dated Mar. 29, 2022 for U.S. Appl. No. 17/388,894 (pp. 1-22).

* cited by examiner

GAMING MACHINE HAVING RELATED TRIGGER CONDITION AND GAME PLAY CHARACTERISTICS

RELATED APPLICATIONS

This application is a continuation of U.S. patent application Ser. No. 16/659,177, filed on Oct. 21, 2019, which is a continuation of U.S. patent application Ser. No. 15/870,393, filed on Jan. 12, 2018, which issued on Oct. 22, 2019, as U.S. Pat. No. 10,453,306, which claims priority to Australian Application No. 2017900082, having a filing date of Jan. 12, 2017, all of which are hereby incorporated herein by reference in their entireties.

FIELD

The present invention relates to gaming machine, a method of operating a gaming machine and a game controller.

BACKGROUND

Gaming machines are known where when a trigger event occurs in a base game, a feature game is triggered. While games are known where more than one feature can be triggered, this can be confusing to the player or make the gaming machine overly complicated.

A need exists for alternative gaming systems.

SUMMARY

In a first aspect, the invention provides an electronic gaming machine comprising: a display; a game play mechanism operable to input a game initiation instruction; a memory storing symbol data defining a plurality of symbols; a random number generator; a symbol selector configured to respond to input of the game initiation instruction by using the random number generator to select a plurality of symbols and causing the selected symbols to be displayed on the display at respective ones of a plurality of symbol display positions; a trigger monitor configured to determine whether one or both of a first feature game trigger condition and a second feature game trigger condition are met by the displayed plurality of symbols; and a feature game controller configured to conduct a first feature game having a first game play characteristic if only the first feature game trigger condition is met, a second feature game having a second game play characteristic if only the second feature game trigger condition is met, and a third feature game that combines the first game play characteristic and the second game play characteristic if both the first and the second feature game trigger conditions are met.

In an embodiment, the plurality of symbols stored in the memory include a first trigger symbol and a second trigger symbol, and wherein the first feature game trigger condition corresponds to a designated number of the first trigger symbols occurring in the selected symbols, and the second feature game trigger condition corresponds to a designated number of the second trigger symbols occurring in the selected symbols.

In an embodiment, the symbol display positions are arranged in a plurality of columns of symbol display positions.

In an embodiment, the symbol data defines a plurality of reels of symbols associated with respective ones of the plurality of columns.

In an embodiment, the symbol selector selects symbols by using the random number generator to select stopping positions for each of the reels.

In an embodiment, the number of symbols in each column is arranged in conjunction with the arrangement of first trigger symbols and second trigger symbols on the reels to control the respective probabilities of the first, second and third feature games being triggered.

In a second aspect, the invention provides an electronic gaming machine comprising: a display; a memory storing symbol data defining a plurality of symbols; a game controller configured to respond to input of a game initiation instruction by randomly selecting a plurality of symbols from the symbol data cause the selected symbols to be displayed on the display at respective ones of a plurality of symbol display positions; determine whether one or both of a first feature game trigger condition and a second feature game trigger condition are met by the displayed plurality of symbols; and conduct: (i) a first feature game having a first game play characteristic if only the first feature game trigger condition is met, (ii) a second feature game having a second game play characteristic if only the second feature game trigger condition is met, and (iii) a third feature game that combines the first game play characteristic and the second game play characteristic if both the first and the second feature game trigger conditions are met.

In a third aspect, the invention provides a method of operating an electronic gaming machine comprising: a display, a game play mechanism operable to input a game initiation instruction, a memory storing symbol data defining a plurality of symbols, and a random number generator, the method comprising: selecting a plurality of symbols using the random number generator in response to input of the game initiation instruction and causing the selected symbols to be displayed on the display at respective ones of a plurality of symbol display positions; determining whether one or both of a first feature game trigger condition and a second feature game trigger condition are met by the displayed plurality of symbols; and conducting: a first feature game having a first game play characteristic if only the first feature game trigger condition is met, a second feature game having a second game play characteristic if only the second feature game trigger condition is met, and a third feature game that combines the first game play characteristic and the second game play characteristic if both the first and the second feature game trigger conditions are met.

In a fourth aspect, the invention provides a game controller for an electronic gaming machine comprising: a display, and a memory storing symbol data defining a plurality of symbols; the game controller configured to: respond to input of a game initiation instruction by randomly selecting a plurality of symbols from the symbol data, cause the selected symbols to be displayed on the display at respective ones of a plurality of symbol display positions, determine whether one or both of a first feature game trigger condition and a second feature game trigger condition are met by the displayed plurality of symbols; and conduct: (i) a first feature game having a first game play characteristic if only the first feature game trigger condition is met, (ii) a second feature game having a second game play characteristic if only the second feature game trigger condition is met, and (iii) a third feature game that combines the first game play characteristic and the second game play characteristic if both the first and the second feature game trigger conditions are met.

In a fifth aspect, the invention provides computer program code which when executed implements the above method.

In a sixth aspect, the invention provides a tangible computer readable medium comprising the above program code.

In a seventh aspect, the invention provides an electronic gaming machine comprising: a display; a memory storing symbol data defining a plurality of symbols and a plurality of feature game triggers, each feature game trigger being defined by a threshold number of a designated symbol; a game controller configured to: conduct a base game; and determine whether one or more of the feature game triggers occurs in the base game and, in response, conduct one of a plurality of feature games, wherein the gaming machine is configured such that there is at least one more feature game than feature game trigger.

BRIEF DESCRIPTION OF THE DRAWINGS

An exemplary embodiment of the invention will now be described with reference to the accompanying drawings in which.

DETAILED DESCRIPTION

Figure 1:
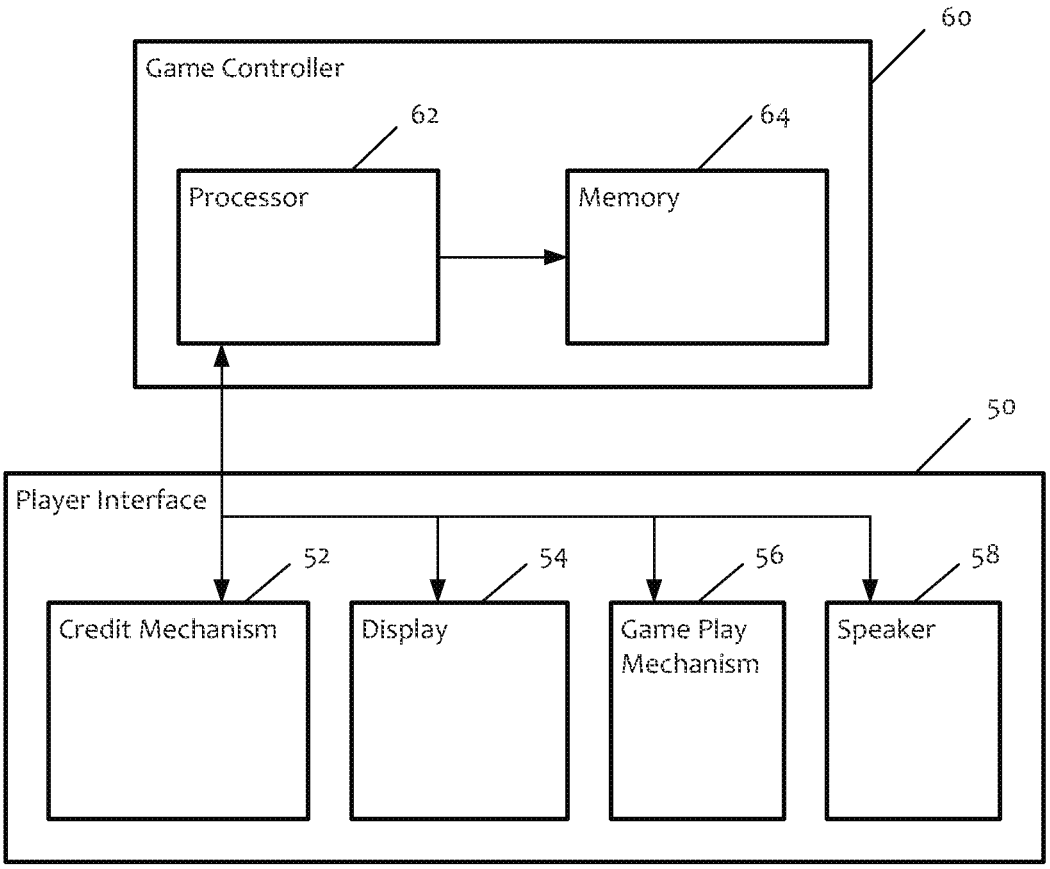
FIG. 1 is a block diagram of the core components of a gaming system.

Referring to the drawings, there is shown a gaming machine having components that enable the implementation of a game having a plurality of feature games where there are also a plurality of feature game triggers. The gaming machine is configured so that there can be fewer feature game triggers than feature games. In one example, there are three feature games and only two feature game triggers and one of the feature games is triggered if both feature game triggers occurs. Advantageously, this improves the efficiency of triggering feature games. For example, by reducing the number of symbols that need to be used as feature game triggers. In an advantageous embodiment, a first feature game has a first game play characteristic, a second feature game having a second game play characteristic, and a third feature game combines the first game play characteristic and the second game play characteristic and is conducted if both the first and the second feature game triggers occur. This use of both game play characteristics in a third feature game makes for a clear relationship between characteristics of each of the trigger conditions and game play in the respective feature games. Thereby allowing a gaming machine to be provided with a plurality of feature games while reducing complexity both in terms of the number of triggers that need to be provided and, from the perspective of the player, the nature of game play.

General Construction of Gaming System

The gaming system can take a number of different forms. In a first form, a standalone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in standalone gaming machine mode, "thick client" mode or "thin client" mode depending on the game being played, operating conditions, and so on. Other variations will be apparent to persons skilled in the art.

Irrespective of the form, the gaming system has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
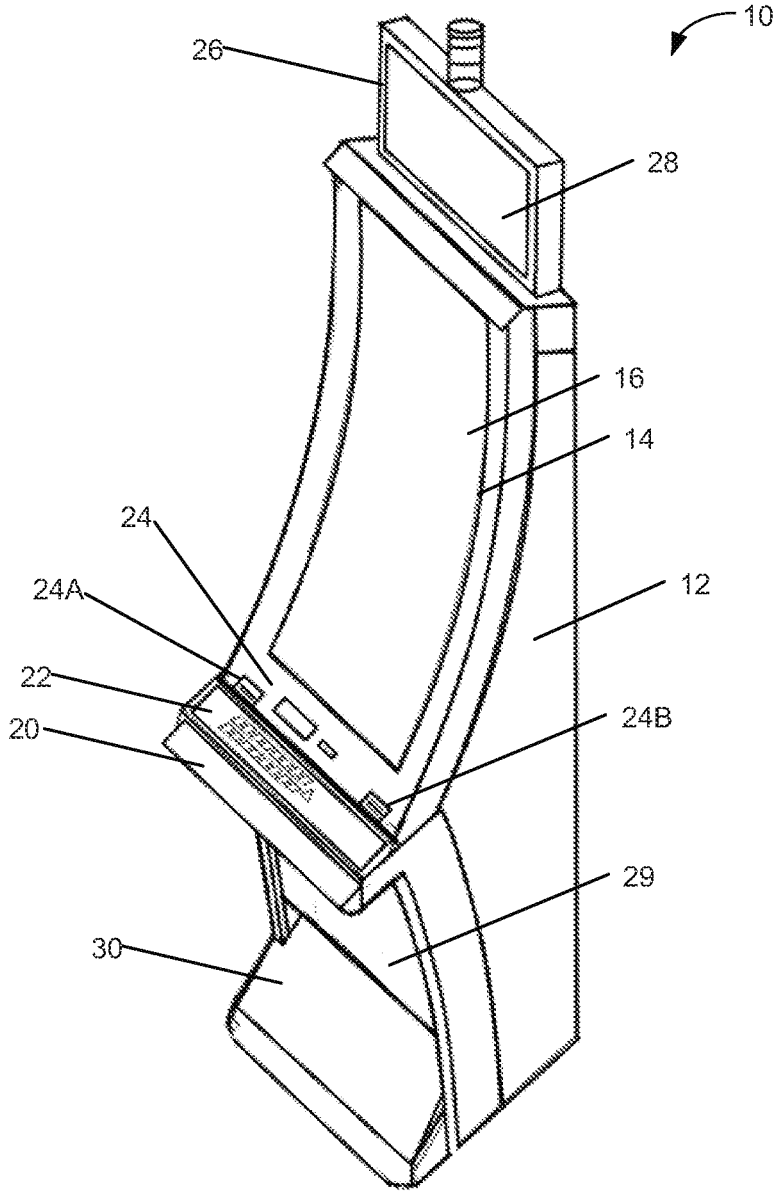
FIG. 2 is a perspective view of a standalone gaming machine.

A gaming system in the form of a standalone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may configure for ticket in such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module that is accessed in response to insertion of the player tracking device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a liquid crystal display. The display 14 may any other suitable video display unit, such as an OLED display. The top box 26 may also include a display, which may be of the same type as the display 14, or of a different type.

Figure 3:
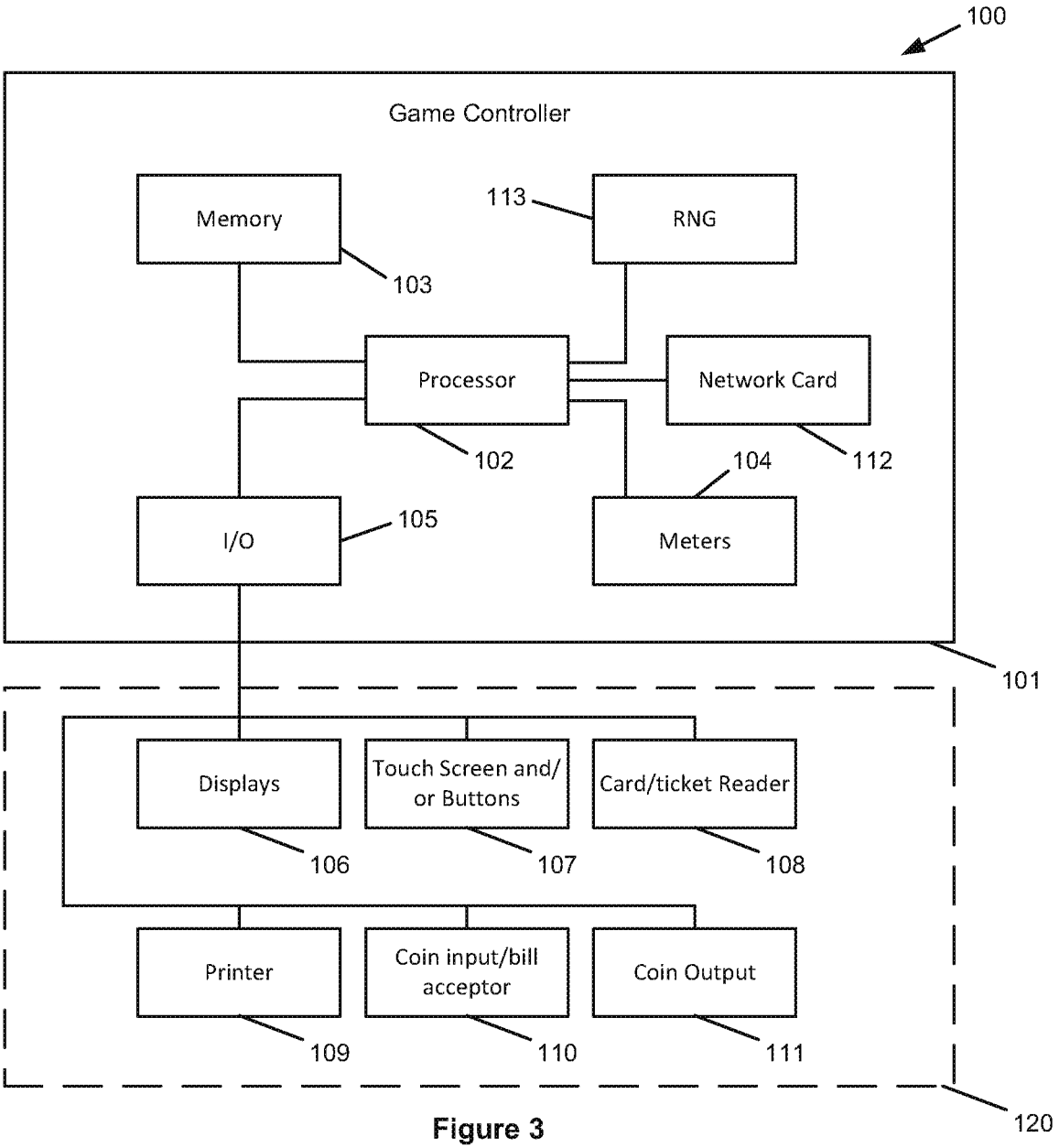
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
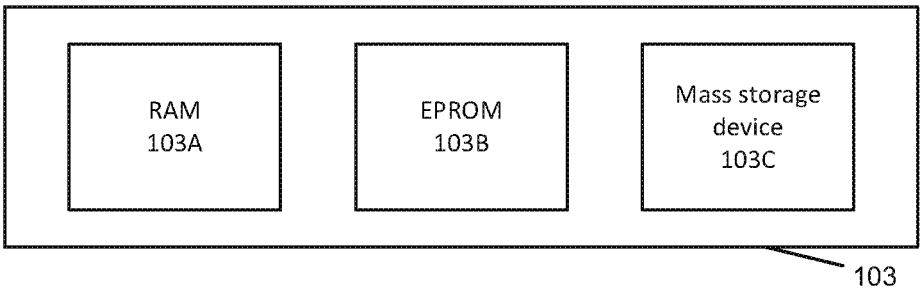
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices such as the one or more displays 106, touch screen and/or buttons 107, card and/or ticket reader 108, printer 109, bill acceptor and/or coin input mechanism 110, coin output mechanism 111 to be provided remotely from the game controller 101.

Figure 5:
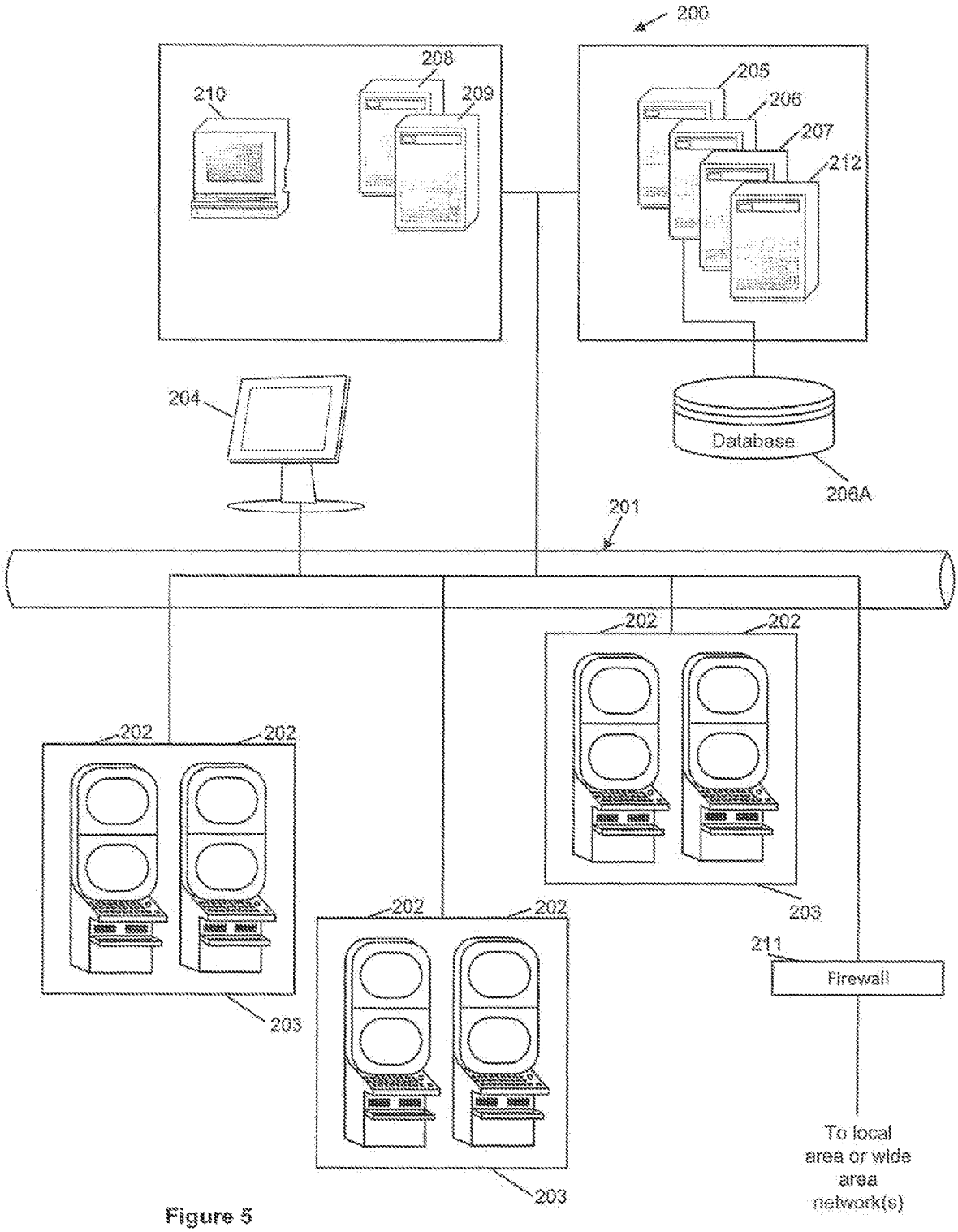
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10, 100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming machines 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming system 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming Machine

The player operates the game play mechanism 56 to specify a wager which will be evaluated for this play of the game and initiates a play of the game. Persons skilled in the art will appreciate that a player's wager can be varied from game to game dependent on player selections. In most spinning reel games, it is typical for the player's wager to be made up of a selection as to how the game outcome will be evaluated by specifying what parts of the game outcome will qualify for winning outcomes and a multiplier that will apply to each winning outcome. For example, a player's wager may be based on how many lines they play in each game—e.g. a minimum of one line up to the maximum number of lines allowed by the game (noting that not all permutations of win lines may be available for selection) and an amount per line—e.g. one, two or five credits. Winning outcomes on an activated win line may be evaluated based on a pay table that specifies the amount awarded for a one credit per line wager multiplied by the amount wagered per line.

Such win lines are typically formed by a combination of symbol display positions, one from each reel, the symbol display positions being located relative to one another such that they form a line.

In many games, the gaming machine may award winning outcomes which are not strictly limited to the lines they have selected, for example, "SCATTER" pays are awarded independently of a player's selection of pay lines.

In embodiments of the invention, the game play mechanism is used to select a number of games to be played concurrently as well as the wager to be applied to each of those games.

Persons skilled in the art will appreciate that in other embodiments, the player may select a number of reels to play or play a fixed number of reels. Games of this type are marketed under the trade name "Reel Power" by Aristocrat Leisure Industries Pty Ltd and are also known as "ways" to win games. The selection of the reel means that each displayed symbol of the reel can be substituted for a symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions comprise three rows of five symbol display positions, the symbols displayed in the centre row are used for non-selected reels. As a result, the total number of ways to win is determined by multiplying the number of active display positions of each reel, the active display positions being all display positions of each selected reel and the designated display position of the non-selected reels. As a result for five reels and fifteen display positions there are 243 ways to win.

In the embodiment described below, the display positions of the symbol display are arranged in a rectangular matrix comprising a plurality of columns and a plurality of rows. However, other arrangements are known in the gaming industry and could be employed in embodiments of the invention. For example, in some arrangements there are more symbols in some columns than others, such as 3-4-3-4-3 arrangement of seventeen display positions corresponding to respective ones of five reels. In such arrangements, the columns of four symbols can be arranged so that they are off-set or staggered relative to the columns having three symbols so that the middle two symbols in the columns of four symbols share boundaries with two symbols of each neighbouring reel.

Figure 6:
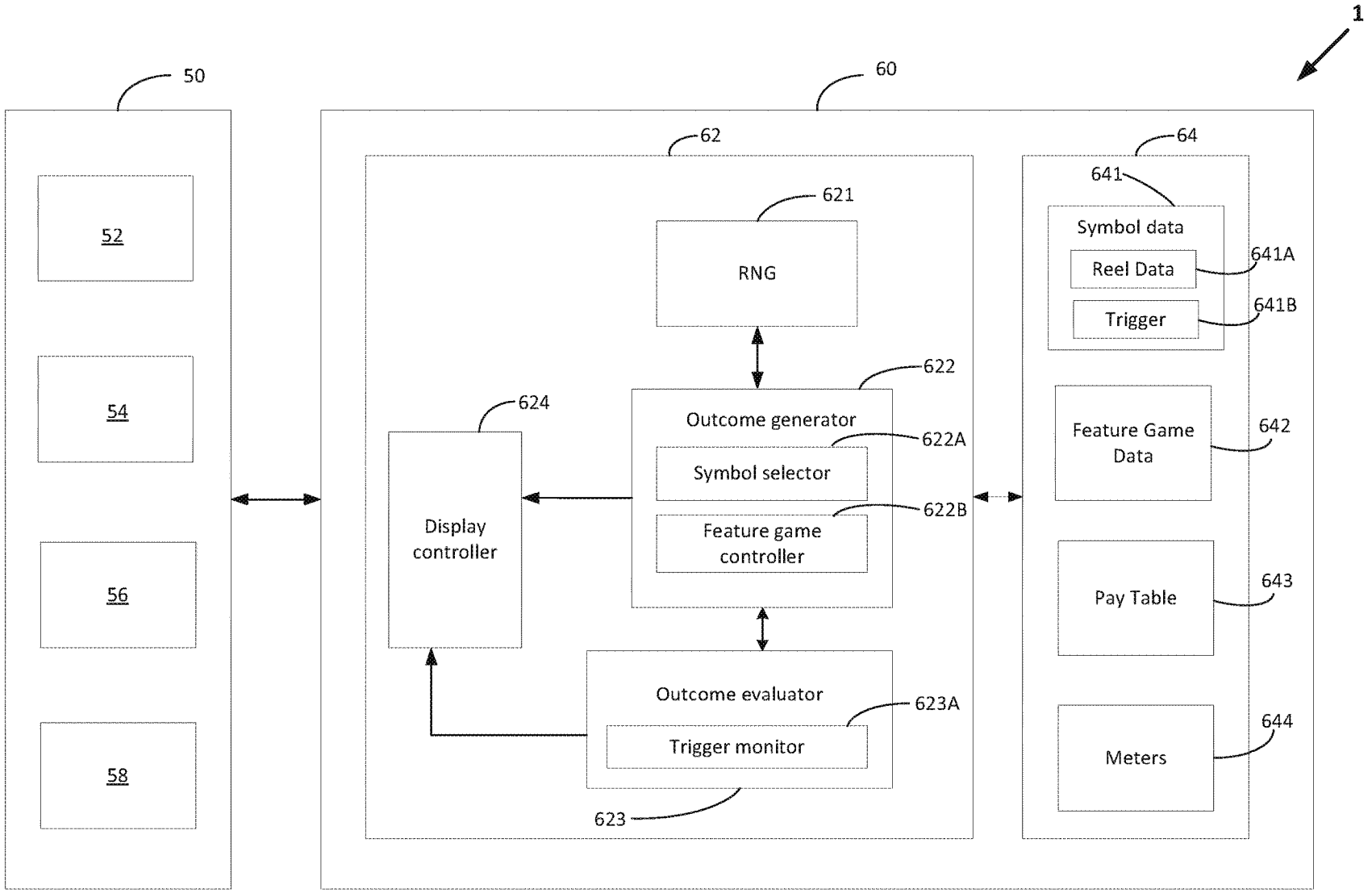
FIG. 6 is a schematic diagram of a game having four separate game display areas.

In FIG. 6, the processor 62 of game controller 60 of gaming machine 1 is shown implementing a number of modules based on program code and data stored in memory 64. Persons skilled in the art will appreciate that one or more of the modules could be implemented in some other way, for example by a dedicated circuit.

Once the player initiates the play of a game by inputting a game initiation instruction in via the game play mechanism 56 (e.g., by making a wager), the symbol selector 622A of the outcome generator 622 uses the random number generator 621 to select a plurality of symbols from symbol data 641.

In an embodiment, the symbol data 641 are stored as a plurality of reels 641A, for example, five reels. The symbol selector 622A uses a value obtained from the random number generator 621 to select a stopping position for each of the reels. The stopping position corresponds to a designated one of the symbol display positions. That is, the reel will be aligned with the stopping position based on the selected stopping position on the reels. In this respect, each reel has a defined order symbols. The selected symbols are caused to be displayed by the outcome generator 622 on the display 54 under control of the display controller 624. The selected symbols are displayed at respective ones of a plurality of symbols display positions. In one example, the symbol display positions are arranged in five columns of four symbols in a five by four grid.

The processor 62 includes an outcome evaluator 623 arranged to compare the selected symbols against a pay table 643 on the basis of the player's game play instructions. For example, as described above, to determine whether the selected symbol on a paid for play line correspond to a winning symbol combination. The outcome evaluator 623 also includes a trigger monitor 623A which compares the selected symbols against triggers 641B to determine whether to trigger one of a plurality of feature games. In the embodiment, each of the triggers includes a defined number of designated trigger symbols. In one example, three scattered trigger symbols ("SCAT" symbols) will correspond to a trigger. In a further example, additional triggered symbols of the same type will lead to conducting a feature game of a different length. In one example, the trigger monitor 623A determines whether one or both of a first feature game trigger condition and a second feature game trigger condition are met. Upon determining that at least one of the trigger conditions is met, the trigger monitor causes the feature game controller 622B to conduct the relevant feature game based on feature game data 642 stored in memory 64.

In this example, the feature game data defines first, second and third feature games. The first feature game has a first game play characteristic, the second feature game has a second game play characteristic, and the third feature game combines the first game play characteristic and second game play characteristic. In an embodiment, the feature game controller 622B is configured to conduct the first feature game if only the first trigger condition is met, the second feature game if only the second feature game trigger condition is met and the third feature game if both the first and second feature game trigger conditions are met. Advantageously, this allows a number of feature games to be offered while minimising the complexity of the trigger arrangement. Further, as both play characteristics are used in the third feature game; there is less risk of confusion for the player. For example, without the technique of the embodiment, a player who has observed the first feature trigger occurring in one instance and resulting in a first game play characteristic being part of a feature game could be confused if the same game play characteristic was not present where the first trigger condition occurred in conjunction with a second trigger condition. Accordingly, the gaming machine reduces the perceived complexity to the user while providing flexibility to have a greater number of feature games. In this respect, it will be noted that in this way, the gaming machine may be configured such that there is at least one more feature game than feature game trigger.

As shown in FIG. 6, the memory 64 stores meter data 644 including credit and win meters so that any awards can be added to the win meter and then transfer to the credit meter, either when a further game play initiation instructions made or if the player choses to cash out. As indicated above, awards by the win meter are made based on the pay table 643.

Figure 7:
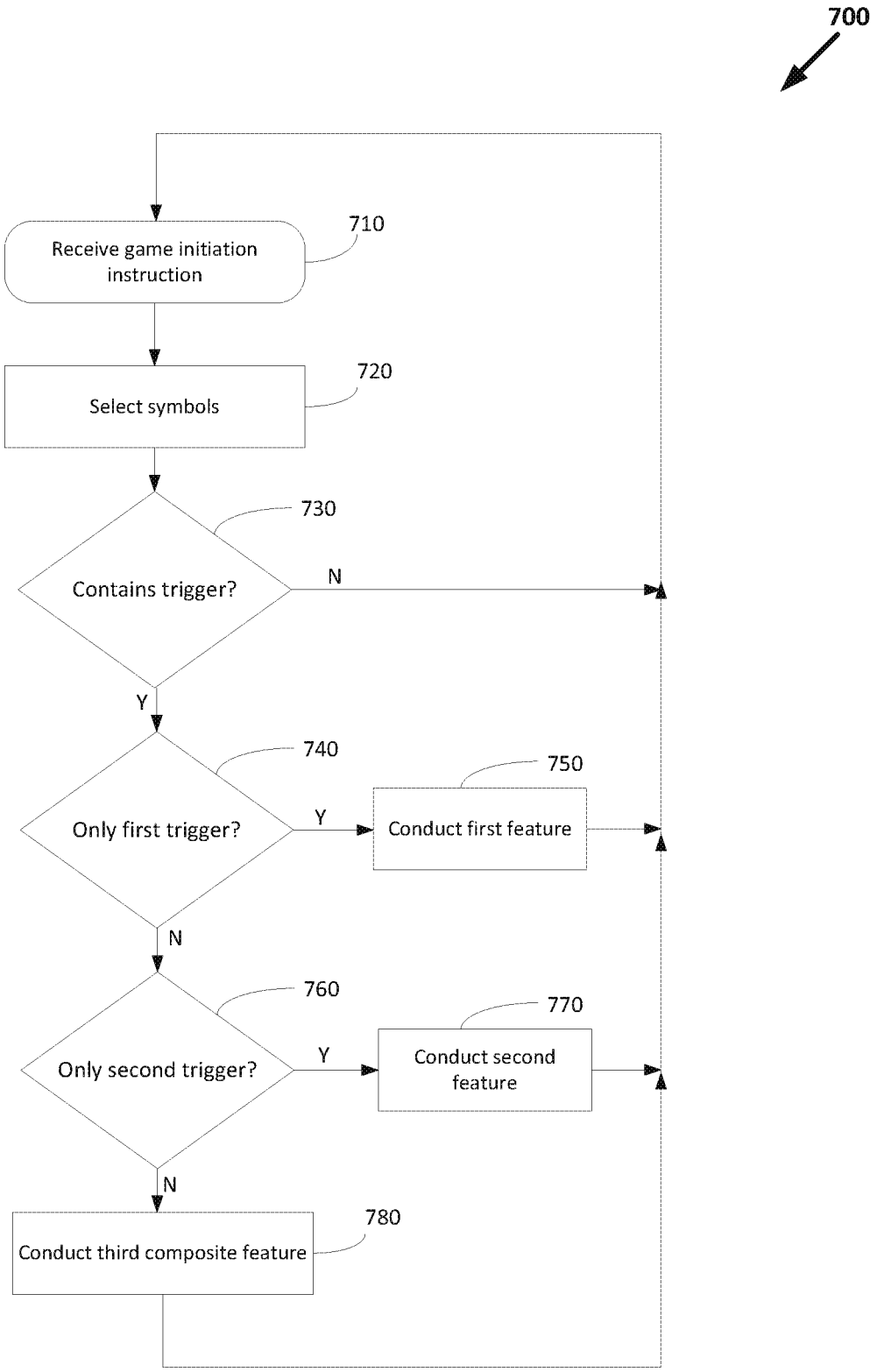
FIG. 7 is a further block diagram of a gaming system.

Referring to FIG. 7, there is shown a flowchart of a method 700 of operating a gaming machine. The method 700 involves receiving a game initiation instruction 710, selecting symbols 720, determining whether the selected symbols correspond to at least one trigger 730 and if not, returning to a wait to receive a further game initiation instruction 710. If the selected symbols do contain at least one trigger, the method determines whether it is only the first trigger 740 in which case the method involves conducting 750 the first feature. The method also involves determining whether the selected symbols contain only the second trigger 760, in which case the method involves conducting the second feature 770. In the alternative both triggers are contained in the selected symbol and the method involves conducting 780 the third composite feature.

It will be apparent to the skilled person that a gaming machine could be configured to conduct more than three feature games if desired. For example, first, second and third triggers could be used to trigger additional feature games.

EXAMPLE

Figure 8A:
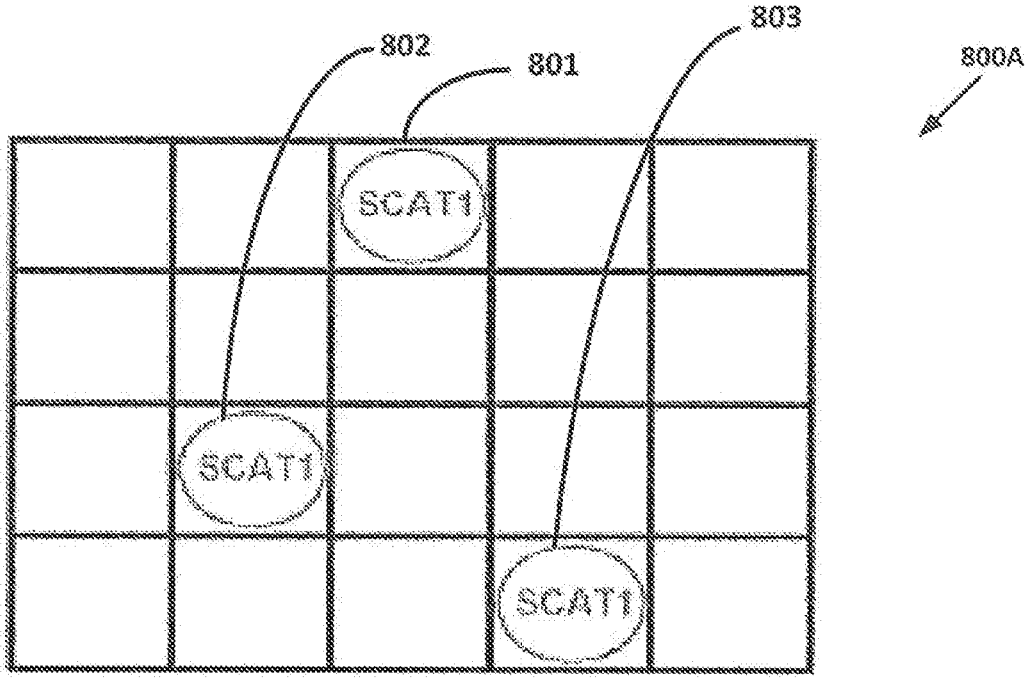
FIGS. 8A, 8B and 8C are block diagrams of outcome generators of first and second modes.
Figure 8B:
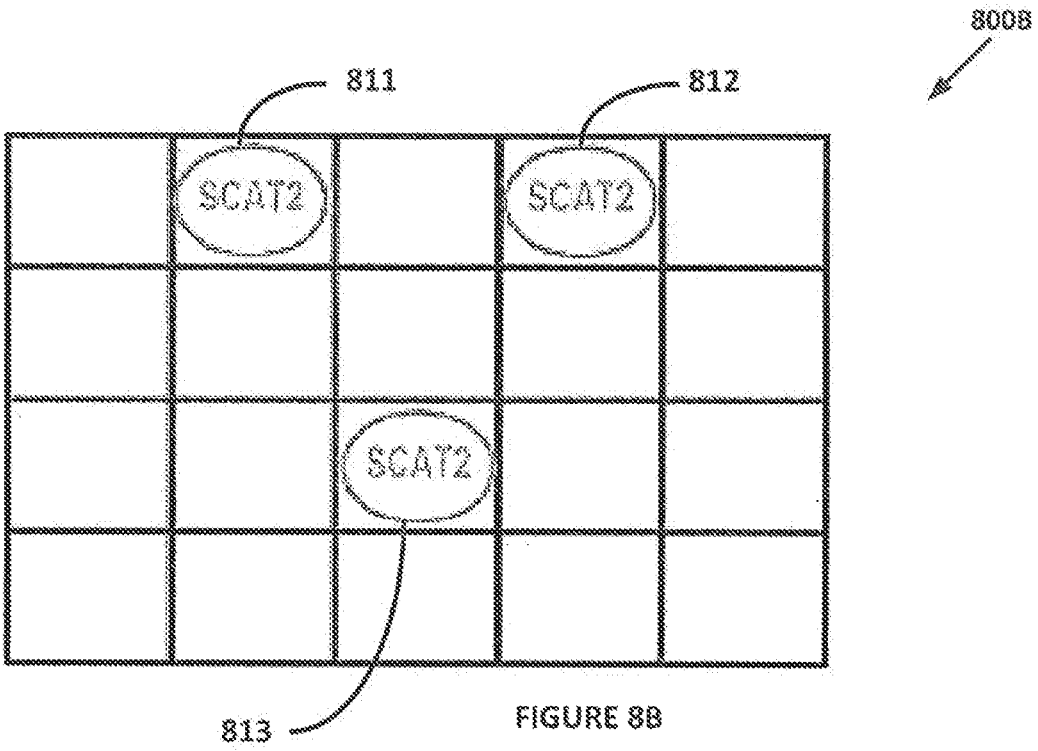
Figure 8C:
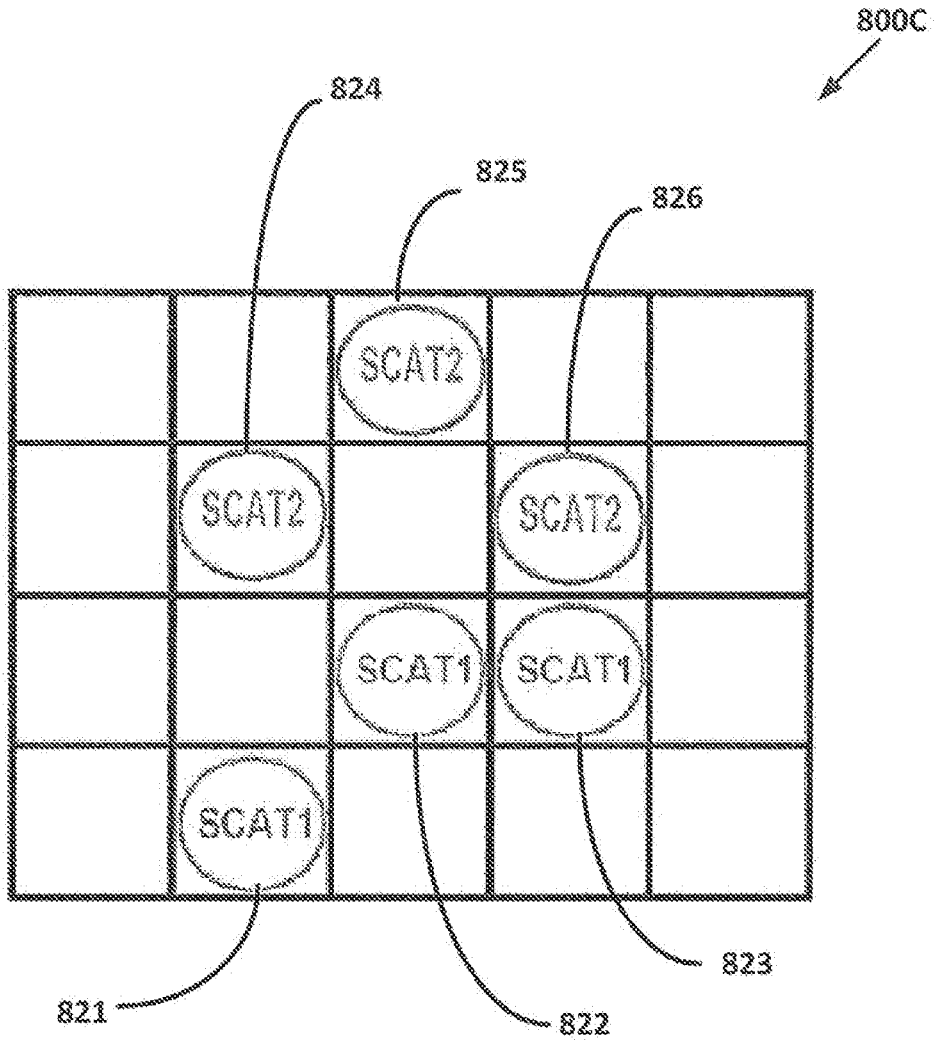

Referring to FIGS. 8A-8C, there is shown an example of an embodiment of the invention. In the example, three or more SCAT1 symbols will trigger a free games feature with the game play characteristic that the free games include a nudging WILD. As shown in the exemplary grid of symbol display positions 800A, three SCAT1 symbols 801, 802 and 803 will cause the free games to trigger. If more than three SCAT1 symbols occur, a larger number of free games will be triggered.

Referring to FIG. 8B, the grid of symbol display positions 800B includes three SCAT2 symbols 811, 812, 813. The occurrence of three SCAT2 symbols will trigger free game feature with bonus prizes appearing on any WILD symbols.

If both three or more SCAT1 symbols and three or more SCAT2 symbols appear in the array of symbol display positions as shown in FIG. 8C a composite feature game is triggered. In this respect, as shown in FIG. 8C, there are three SCAT1 symbols, 821, 822, 823 and three SCAT2 symbols 824, 825 and 826.

The composite feature has both the game play characteristic of the nudging WILD feature and the game play characteristic of bonus prizes appearing on the WILDs. A benefit of this arrangement is that WILD symbols will appear on the screen more often since they are being nudged onto the screen, giving more wins which in turn gives more bonus prizes because the more WILDs there are, the more bonuses are awarded. Thus, the third feature game that is offered is the combination of the nudging WILDs and bonus prizes but it is achieved in a way that does not overcomplicate the way in which the features are triggered. Thus, it avoids frustration and confusion for the player.

It will be apparent from the description above, that the base game is a part of the game which is carried out each time the player makes a wager, typically irrespective of the wager, whereas a feature game will only be carried out occasionally when one of the triggers occurs.

Persons skilled in the art will appreciate that a feature game involves some additional element of game play which usually only occurs when a trigger condition is met. Types of feature games include: those where a series of free game events are awarded such as free games or re-spins (where some reels are held while others are re-spun); games where the symbols on the reel are changed; and "second screen" games where game play is totally different to the base game, for example where the player makes selections in a "pick a box type" game.

Typically, a winning outcome will result in some form of award being made such as an award of credits. Such an award may never actually be physically received by a player. For example, many gaming systems provide a player with a double or nothing gamble feature, where the player can double or forfeit their credits before commencing another play of the game or cashing out. Further, as credits are fungible, once credits have been added to the credit meter it is not possible to distinguish between credits which exist because the player has input cash or the like and credits resulting from an award.

Further aspects of the method will be apparent from the above description of the system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art will appreciate that program code provides a series of instructions executable by the processor.

It will be understood to persons skilled in the art of the invention that many modifications may be made without departing from the spirit and scope of the invention. In particular it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

What is claimed is:

1. A electronic gaming machine comprising:

a display device; and a game controller comprising at least one processor and a memory, the memory storing i) a symbol set including a plurality of trigger symbols, ii) a plurality of characteristics, and iii) instructions, wherein the instructions, when executed, causes the at least one processor to at least:

display a plurality of symbols selected from the symbol set based on a random number generated from a random number generator, display a first game having a first number of the plurality of characteristics in response to the plurality of symbols displayed include at least two of plurality of trigger symbols, and wherein the first number of the plurality of characteristics is greater than the at least two of the plurality of trigger symbols, and display a second game having a second characteristic in response to the plurality of symbols displayed include only a second trigger symbol of the plurality of trigger symbols.

2. The electronic gaming machine of claim 1, wherein the instructions, when executed, further cause the at least one processor to display the first game combining at least two of the plurality of characteristics.

3. The electronic gaming machine of claim 1, wherein the instructions, when executed, further cause the at least one processor to display the first game in response to the plurality of symbols displayed simultaneously include the at least two of plurality of trigger symbols.

4. The electronic gaming machine of claim 1, wherein the second characteristic is a part of the first number of the plurality of characteristics.

5. The electronic gaming machine of claim 1, wherein the first number of the plurality of characteristics is one more than the at least two of plurality of trigger symbols.

6. A electronic gaming system comprising:

a display device; and a game controller comprising at least one processor and a memory, the memory storing i) a symbol set including a plurality of trigger symbols, ii) a plurality of characteristics, and iii) instructions, wherein the instructions, when executed, causes the at least one processor to at least:

select a plurality of symbols from the symbol set for display on the display device based on a random number generated from a random number generator;

evaluate the plurality of symbols selected for one or more of a plurality of trigger conditions;

initiate a first game having a first characteristic in response to only a first trigger condition of the plurality of trigger conditions occurring; and initiate a composite game having more of the plurality of characteristics than the plurality of trigger conditions determined in response to at least two of the plurality of trigger conditions occurring.

7. The electronic gaming system of claim 6, wherein the instructions, when executed, further causes the at least one processor to initiate the composite game to determine if the at least two of the plurality of trigger conditions occur simultaneously.

8. The electronic gaming system of claim 6, wherein the instructions, when executed, further causes the at least one processor to initiate the composite game to combine at least two of the plurality of characteristics.

9. The electronic gaming system of claim 6, wherein the first characteristic is used in the composite game.

10. The electronic gaming system of claim 6, wherein the at least two of the plurality of trigger conditions correspond to a first designated number of symbols and a second designated number of symbols occurring in the plurality of symbols selected.

11. The electronic gaming system of claim 6, wherein the first trigger condition corresponds to a first designated number of symbols occurring in the plurality of symbols selected, and wherein the instructions, when executed, further causes the at least one processor to initiate a second round of the first game with the first characteristic only when the plurality of symbols selected include more designated symbols than the first designated number of symbols.

12. The electronic gaming system of claim 6, wherein the composite game has one characteristic more than the plurality of trigger conditions.

13. A non-transitory computer-readable medium comprising: i) a symbol set, ii) a plurality of trigger conditions, iii) a plurality of games having a plurality of characteristics, respectively, and iv) instructions for conducting a game on a gaming system including a display device and a game controller having a processor, the instructions, which, when executed, cause the processor to perform at least the steps of:

selecting a plurality of symbols from the symbol set for display based on a random number generated from a random number generator;

determining whether one or more of the plurality of trigger conditions are met by the plurality of symbols selected; and combining two or more of the plurality of characteristics for use with a composite game when two or more of the plurality of trigger conditions are met.

14. The non-transitory computer-readable medium of claim 13, wherein the instructions, when executed, cause the processor to perform the step of conducting the composite game when the two or more of the plurality of trigger conditions are met simultaneously.

15. The non-transitory computer-readable medium of claim 13, wherein a first trigger condition of the plurality of trigger conditions corresponds to a first designated number of symbols occurring in the plurality of symbols selected, and a second trigger condition of the plurality of trigger conditions corresponds to a second designated number of symbols occurring in the plurality of symbols selected.

16. The non-transitory computer-readable medium of claim 15, wherein the instructions, when executed, cause the processor to perform the step of conducting a second round of the composite game when both the two or more of the plurality of trigger conditions are met, and when the plurality of symbols selected include more designated symbols than the first designated number of symbols.

17. The non-transitory computer-readable medium of claim 13, wherein the instructions, when executed, cause the processor to perform the step of conducting a first game having a first characteristic when only a first trigger condition of the plurality of trigger conditions is met.

18. The non-transitory computer-readable medium of claim 17, wherein the first trigger condition corresponds to a first designated number of symbols occurring in the plurality of symbols selected, and the instructions, when executed, cause the processor to perform the step of conducting the first game of the plurality of games with the first game characteristic only when the plurality of symbols selected include the first designated number of symbols.

19. The non-transitory computer-readable medium of claim 17, wherein the two or more of the plurality of characteristics is greater than the plurality of trigger conditions determined.

20. The non-transitory computer-readable medium of claim 19, wherein the two or more of the plurality of characteristics is one more than the plurality of trigger conditions determined.

* * * * *